US006578837B1

(12) United States Patent
Blank et al.

(10) Patent No.: US 6,578,837 B1
(45) Date of Patent: Jun. 17, 2003

(54) CLAMPING TOOL, ESPECIALLY A CLAMPING CLIP, CLAMPING ROD OR CLAMPING BENCH

(75) Inventors: Stefan Blank, Neuwied (DE); Zbigniew Noniewicz, Kempenich (DE); Klemens Degen, Weibern (DE); Hans-Jürgen Schüller, Königsfeld (DE)

(73) Assignee: wolfcraft GmbH, Kempenich (DE)

( * ) Notice: Subject to any disclaimer, the term of this patent is extended or adjusted under 35 U.S.C. 154(b) by 0 days.

(21) Appl. No.: 09/463,478

(22) PCT Filed: Jun. 26, 1998

(86) PCT No.: PCT/EP98/03915

§ 371 (c)(1),
(2), (4) Date: Apr. 16, 2001

(87) PCT Pub. No.: WO99/04932

PCT Pub. Date: Feb. 4, 1999

(30) Foreign Application Priority Data

Jul. 23, 1997 (DE) ..... 197 31 579

(51) Int. Cl.[7] ..... B25B 1/00
(52) U.S. Cl. ..... 269/6; 269/3; 269/170
(58) Field of Search ..... 269/6, 3, 165–171.5, 269/147–150, 203–204; 81/487

(56) References Cited

U.S. PATENT DOCUMENTS

| | | | | |
|---|---|---|---|---|
| 2,688,351 A | | 9/1954 | Sweet | |
| 3,427,016 A | | 2/1969 | Harris | |
| 4,563,921 A | | 1/1986 | Wallace | |
| 4,989,847 A | * | 2/1991 | Chapman | 269/170 |
| 5,197,360 A | * | 3/1993 | Wooster, Jr. | 269/170 |
| 5,853,168 A | * | 12/1998 | Drake | 269/6 |
| 6,113,085 A | * | 9/2000 | Lindenthal et al. | 269/6 |
| 6,254,073 B1 | * | 7/2001 | Noniewicz et al. | 269/6 |
| 6,382,608 B1 | * | 5/2002 | Michell | 269/6 |
| 6,386,530 B1 | * | 5/2002 | Marks | 269/6 |

FOREIGN PATENT DOCUMENTS

| | | |
|---|---|---|
| DE | 39 17 473 A1 | 5/1989 |
| DE | 296 05 900 U1 | 3/1996 |
| GB | 2 178 689 A | 6/1985 |
| GB | 2 273 073 A | 2/1991 |

* cited by examiner

*Primary Examiner*—Lee D. Wilson
(74) *Attorney, Agent, or Firm*—Bell, Boyd & Lloyd LLC

(57) ABSTRACT

A clamping tool having a first jaw connected to a pull/push rod and a fixed second jaw connected to a housing which includes a handle disposed opposite the second jaw and arranged along side a grip provided on the housing. Displacement of the handle towards the grip moves the first jaw towards the second jaw and towards a clamping position in a stepwise manner while reverse movement of the rod and jaws is blocked by a detent member. Release of the detent member is provided by a release lever. The release lever can also be utilized, in conjunction with the detent member, to move the rod and first jaw in a release direction. Movement of the rod and first jaw in the clamping direction is caused by engagement of the rod by a carry-along member. The carry-along member, in turn, is engaged by an operating arm which, in turn, is engaged by the handle. The operating arm is slidably connected to the housing thereby enabling the overall length of the operating arm and handle to be varied. The operating arm engages a smooth surface of the carry-along member so that as the clamping force increases, the operating arm will move away from the rod and towards the handle thereby decreasing the overall length of the operating arm and handle.

21 Claims, 9 Drawing Sheets

1
2
33
10
15
3
3"

CLAMPING TOOL, ESPECIALLY A CLAMPING CLIP, CLAMPING ROD OR CLAMPING BENCH

FIELD OF THE INVENTION

The present invention relates generally to clamps and, more specifically, clamping having a first jaw connected to a rod that passes through a housing which incorporates a second jaw. The housing also includes an actuating handle for moving the two jaws together towards a clamping position.

A clamping tool of the type in question in the form of a clamp is known from German Patent Application DE 39 17 473. This known clamp has a movable clamping jaw which is fitted at the end of a push rod. This clamping jaw engages through a housing which carries a second, fixed clamping jaw. A grip projects from the housing. By means of a handle, which is arranged pivotably on the housing and can be moved towards the grip, the push rod can be displaced such that the movable clamping jaw is moved in a stepwise manner towards the fixed clamping jaw. On the handle side, in the direction of the two clamping jaws, the previously known clamp has a releasable detent against reverse displacement, in the form of a clamping lever. This is intended to prevent the movable clamping jaw from being able to be displaced in the opposite direction. A free end of the lever forming the return displacement detent projects out of the housing there and can be pivoted in order to release the return displacement detent. In the released position, the two clamping jaws can be moved apart in opposite directions. The plane which is defined by the jaw surface of the fixed clamping jaw and runs substantially transversely to the direction of extent of the push rod is located directly in front of the free end of the lever of the return displacement detent lever. This results, in the case of unfavourable spatial conditions, in the position of the workpiece located in the said plane adversely affecting actuation of the lever. Furthermore, in the case of a clamp of this kind, the fact that the free end of the push rod can be displaced rearwards in a stepwise manner in relation to the grip upon actuation is disadvantageous.

If the clamp is used, for example, in such a manner that the clamping-jaw plane is located in the horizontal, and if the clamp is to be placed in position from above, then the free push-rod end projects upwards into the space in a disruptive manner. Although this clamp allows use in a large number of clamping circumstances, reliable release of the clamping jaws is not guaranteed in specific clamping circumstances, in particular in the abovementioned clamping circumstances. There is also only a small actuating path available for the clamping lever.

From U.S. Pat. No. 3,427,016, a further clamp is known. In this, a rotatable, toothed rod is fitted parallel to the push rod and has one end of a pivotable handle engaging in it. The two clamping jaws can be moved towards one another by engagement in the teeth. In this case, the two clamping jaws are located to the rear of the actuating handle. Although a catch is fitted in the housing, the catch acting as return displacement detent, this is not itself intended to be releasable. In order to release the return displacement detent, the toothed rod has to be rotated by engagement on a lever fitted to the movable jaw. It is also the case with this clamp that the release of the return displacement detent leaves room for improvement.

A clamp is also known from Utility Model 87 03 379.8. In this case, although the release lever of the return displacement detent is remote from the movable jaws, the problem mentioned in the introduction arises if clamping surfaces located in the horizontal plane are to be clamped from above.

A further clamp is known from GB 21 78 689. The handleability of this clamp corresponds approximately to that of Utility Model 87 03 379.8.

From U.S. Pat. No. 2,688,351, a clamp is already known in which the pull rod, on one side, provides a toothing arrangement in which there engages a catch which can be displaced by a handle, the handle being displaceable towards the grip, in order thus for the movable jaw, located at the end of the pull rod, to be displaced towards the fixed jaw, which is fitted to the housing. As detent against return displacement, this clamping tool has a second detent catch, which is encapsulated in the housing, engages in the toothing arrangement by spring bias and, for rearward displacement of the movable clamping jaw, has to be displaced out of the toothing arrangement. This displacement is effected by transverse pivoting.

The invention is based on the problem of developing a clamp of the type in question such that reliable release of the clamping is possible for all clamping circumstances, and that it can be placed in position in a more functionally advantageous manner during clamping.

The object is achieved by the invention specified in Claim 1. Subsidiary claims provide advantageous. According to the invention, it is provided first and foremost that a release lever acts on the return displacement detent, and that both the handle and the release lever are located on that side of the grip which is directed away from the clamping zone between the two clamping jaws.

On account of this configuration, although the release lever is located in a position remote from the clamping zone, it is, at the same time, at a defined spacing from that side of the workpiece which is directed towards the release lever. Even in unfavourable clamping circumstances in which that surface of the workpiece which is directed towards the release lever extends beyond the push rod to the grip side or actuating-member side of the push rod, reliable actuation of the release lever is possible. On account of an aligned arrangement of the rear side of the grip in relation to the clamping surface of the fixed clamping jaw, this grip, in certain clamping operations, can even perform a workpiece-supporting function. Located between the rear side and the fixed clamping jaw is a rearwardly projecting slot from which the push rod projects. Since the handle is located between release lever and grip and the grip is located nearest the clamping zone or the workpiece, it is even possible for the handle to be used as a second grip for the purpose of actuating the release lever. For this purpose, in particular an approximately triangular clearance located between the handle and grip has proven advantageous. Furthermore, the handle actuation, directed counter to the push-rod displacement, makes for favourable pivoting of the release lever and handle on the housing. The pivot points for the two levers are located on the same side of the push rod, to be precise such that in order to actuate the release lever, rather than having to clasp the grip, all that is required is to clasp the handle protecting freely from the housing. The fixed clamping jaw is located on the opposite side of the pivot points or of the grip portions. It is advantageous if the release lever is associated with that end of the housing which is located opposite the fixed jaw.

A second aspect of the invention relates to development of the release lever. The release lever is configured such that the first clamping jaw is displaced rearwards in a stepwise manner above the second clamping jaw by actuation of the release lever. This configuration ensures proper single-handed use of the clamping tool. In a preferred configuration, the return displacement detent has a slide which can be latched or clamped to the pull or push rod. This slide can be displaced freely over the pull or push rod by the release lever counter to the force of a return spring. When actuation of the release lever is completed, the slide is then displaced into a clamping or latching position and is displaced back by the return spring, the pull or push rod being carried along in the process. The return spring preferably acts on one side of the slide and thus produces, in the absence of counter-clamping or counter-support of the opposite side, a tilted position. In order to be able to slidingly displace the slide over the pull or push rod, it is advantageous if an arm of the release lever presses on the slide at the engagement end for the return spring in order to release the detent action upon actuation. The release lever may, furthermore, form a stop for the opposite side of the slide, by means of which the opposite side of the slide can be pressed against a fixed stop. For this purpose, the release lever is of fork-like design on the operating side. For this stepwise rearward displacement of the push rod, it is advantageous if the release lever is actuated by a hand using the handle as a grip. The handle can be grasped by one hand since a clearance is provided between the grip and the handle, running obliquely at an angle to the grip, and the clearance allows the actuating handle to be clasped. It is not then necessary for the hand to enclose the grip in order, for release-lever actuation, to be able to grasp a total of two levers, namely the handle as well.

A further aspect of the invention provides that the lever ratios of the lever transmission can be altered in a load-dependent manner. With increasing clamping force, which increases when a workpiece is clamped in between the two clamping jaws, the lever ratios of the lever transmission alter to the effect that the path of displacement of the clamping jaw becomes smaller and thus, following the lever principle, the force which can be applied is increased. The ratio between the operating arm and power arm of the lever transmission is variable, in favour of a clamping force which increases under load. The altered lever ratios are preferably realized in that the operating arm, which acts on the pull or push rod, is a shortenable arm of an actuating lever. The shortenable operating arm may then act on an engagement surface of the carry-along slide. In a preferred configuration, it is provided that the capacity for shortening the operating arm is achieved by the actuating lever providing an alterable bearing point. This alterable bearing point may be realized, for example, by the pivot mounting of the actuating lever being defined by a fixed bearing pin and the actuating lever being fitted to this bearing pin by way of a slot, with the result that the actuating lever can be displaced in a load-dependent manner. The slot then extends in the direction of extent of the lever. The actuating lever is preferably of two-armed design. If the first arm is formed by the operating arm, then the second arm may be pivotable by the handle. In a preferred configuration of the invention, it is provided that the operating arm is spring-biassed in the direction of engagement. In the case of increasing resistance, the operating arm presses on the biassed spring. When the spring loading is exceeded, it is possible for the operating arm to be displaced and thus shortened.

In an embodiment, the present invention provides a clamp that comprises a first jaw connected to an end of a rod, a second jaw connected to a housing, the rod passing through the housing, the housing being connected to a pivotable handle, the housing accommodating a carry-along member that engages the rod and the handle, the housing also accommodating a detent member that engages the rod, the housing also comprising a grip, the handle being pivotable towards the grip whereby, as the handle is pivoted towards the grip, the handle imparts movement to the carry-along member which imparts movement to the rod in a clamping direction in a stepwise manner while engagement of the detent member and the rod prevents reverse movement of the rod in a release direction, the housing also being connected to a pivotable release lever which, upon pivotal movement towards the grip, engages the detent member to release the detent member from the rod to permit movement of the rod in the release direction, the grip being disposed opposite the rod from and directed away from the first and second jaws, the handle and release lever being disposed in alignment with the grip and on a same side thereof.

In an embodiment, the release lever is disposed diagonally opposite the housing from the second jaw with the handle being disposed between the release lever and the grip.

In an embodiment, the grip is aligned with the second jaw but opposite the rod from the second jaw.

In an embodiment, the present invention provides a clamp that comprises a first jaw connected to an end of a rod, a second jaw connected to a housing, the rod passing through the housing, the housing being connected to a pivotable handle, the handle engaging an operating arm, the operating arm being slidably connected to the housing so that the operating arm is capable of sliding movement with respect to the handle to shorten or lengthen an overall combined length of the handle and operating arm, the housing accommodating a carry-along member that engages the rod and the operating arm, the housing also accommodating a detent member that engages the rod, as the handle is pivoted, the operating arm imparts force and movement to the carry-along member which imparts movement to the rod in a clamping direction in a stepwise manner while engagement of the detent member and the rod prevents reverse movement of the rod in a release direction, the housing also being connected to a pivotable release lever which can engage the detent member to release the detent member from the rod to permit movement of the rod in the release direction, the carry-along member being biased against the force and movement imparted by the operating arm, wherein as a clamping force increases, the operating arm slides towards the handle to shorten the overall length of the handle and operating arm.

In an embodiment, the carry-along member comprises a smooth surface which is engaged by the operating arm.

In an embodiment, the operating arm is connected to the housing by a pin that is received in a slot disposed in the operating arm.

In an embodiment, the operating arm and the handle form an actuating lever which has an alterable bearing point.

In an embodiment, the handle engages a second arm which, in turn, engages the operating arm.

In an embodiment, the operating arm is spring biased away from the handle to lengthen the overall length of the operating arm and handle.

In an embodiment, the operating arm is angled and comprises a vertex, the slot being disposed in the vertex of the operating arm.

In an embodiment, the first jaw may be connected to one of two ends of the rod.

In an embodiment, the second arm is biased towards the slot in the operating arm by a spring.

In an embodiment, the handle comprises a cavity for slidingly receiving the second arm.

In an embodiment, the present invention provides a clamp that comprises a first jaw connected to an end of a rod, a second jaw connected to a housing, the rod passing through the housing, the housing being connected to a pivotable handle, the housing accommodating a carry-along member that engages the rod and the handle, the housing also accommodating a detent member that engages the rod, as the handle is pivoted, the handle imparts force and movement to the carry-along member which imparts movement to the rod in a clamping direction in a stepwise manner while engagement of the detent member and the rod prevents reverse movement of the rod in a release direction, the carry-along member being biased against the force and movement imparted by the handle arm, the housing also being connected to a pivotable release lever which can engage the detent member to release the detent member from the rod to permit movement of the rod in the release direction, the detent member being biased against the force and movement imparted by the release lever, further pivotal movement of the release lever imparting sufficient force and movement to the detent member along the rod until the detent member reengages the rod and the biasing force imposed on the detent member imparts movement of the rod in the release direction upon disengagement of the release lever from the detent member.

In an embodiment, the present invention further comprises a return spring which engages one side of the detent member while a fixed stop engages an opposing side of the detent member.

In an embodiment, the release lever engages said one side of the detent member.

In an embodiment, the carry-along member comprises an opening through which the rod passes and the opening comprises at least one side edge for grippingly engaging the rod.

In an embodiment, the detent member comprises an opening through which the rod passes and the opening comprises at least one side edge for grippingly tengaging the rod.

Other objects and advantages of the present invention will become apparent from reading the following detailed description and appended claims, and upon reference to the accompanying drawings.

Two exemplary embodiments of the invention are explained hereinbelow with reference to the accompanying drawings, in which:

FIG. 3 shows an illustration with the handle partially actuated, the two clamping jaws having been moved together to the full extent with a work piece clamped in between;

FIG. 7 shows a constructional variant in which the clamping tool is formed as a spreading-action clamp;

Figure 1:
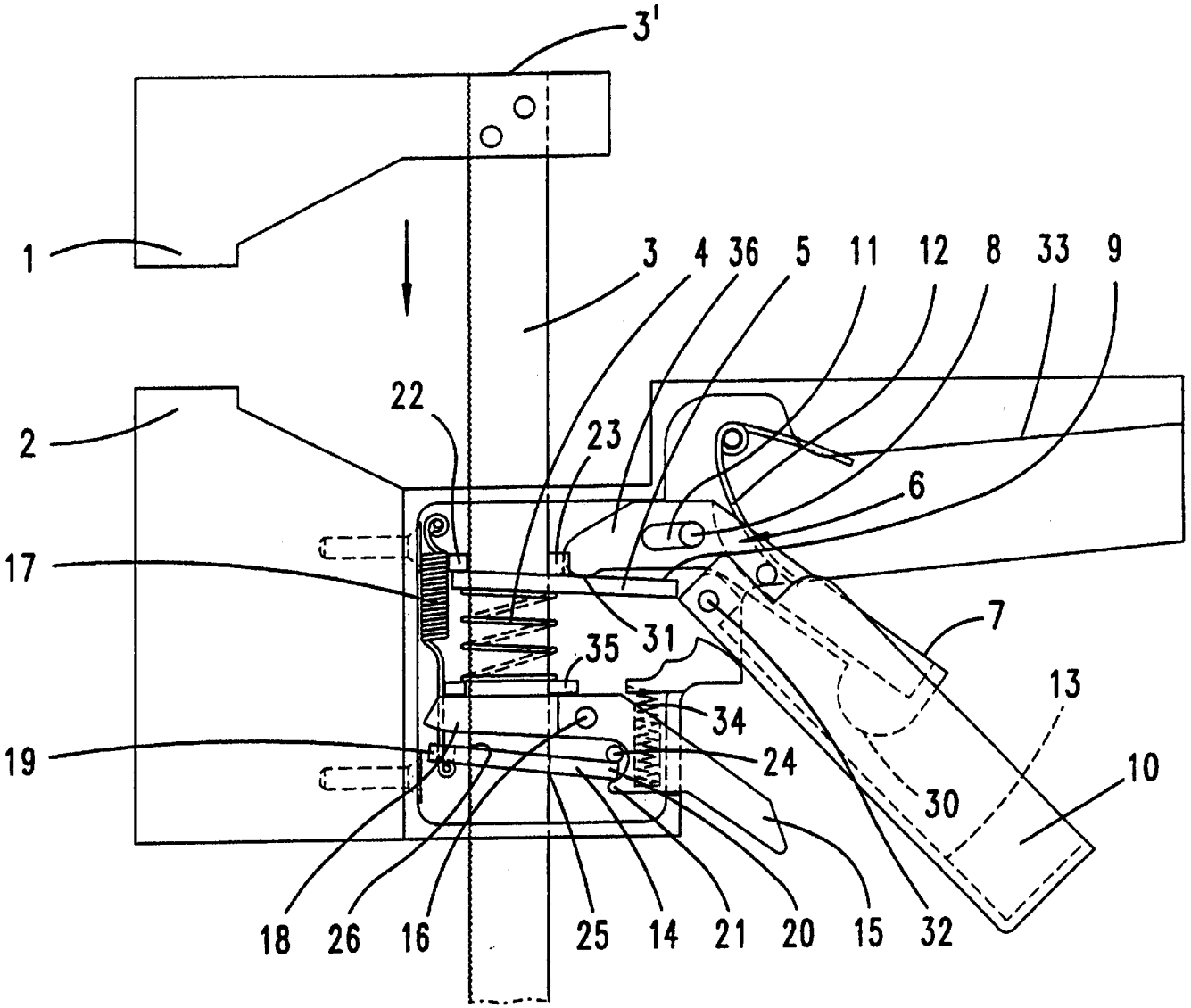
FIG. 1 shows a clamping tool according to the invention configured as a clamp, in a first, non-clamping position.

The clamp has a first clamping jaw 1 and a second clamping jaw 2. The first clamping jaw 1 is fixedly connected to one 3' of the ends of the pull or push rod 3 by releasable connections, for example push-in connections, screws or the like. The clamping jaw 2 has a stepping-mechanism housing which has the push rod 3 passing through it.

The stepping-mechanism housing continues into a grip portion 33. Located at the starting region of the grip portion 33 is a pivot pin 32 about which a handle 10 can be pivoted from an angled spaced-apart position into an abutment position against the grip portion 33. Adjacent to the handle 10, an arm of a release lever 15 projects out of the mechanism housing, the lever being mounted in spring-biassed manner with respect to the housing by means of a compression spring 34. In the rest position, the operating arm 18 of the release lever 15 engages against a fixed stop 35. The operating arm 18 has a hole through which the pull or push rod 3 extends. Located parallel to the operating arm 18 of the release lever 15, which can be pivoted about the bearing pin 16, is a detent slide 14, at the engagement end 19 of which a return spring 17 engages and urges the detent slide 14 counter to the displacement direction of the pull or push rod 3. The opposite side 20 of the detent slide 14 rests, in the rest position, against a fixed stop 24.

The handle 10 has a cavity 13. The handle is configured in the form of a U in the region of the cavity 13. The second arm 7 of an actuating lever 6 engages in this cavity. The actuating lever 6 has an angled configuration and its second arm 6', which defines an operating arm, engages against an engagement surface 9 of a carry-along slide.

The carry-along slide 5, just like the detent slide 14, has an opening through which the pull or push rod 3 projects. Just like the corresponding opening of the detent slide 14, the opening of the carry-along slide 5 has edges in order to be able to tilt into engagement with the pull or push rod 3.

In the rest position, the carry-along slide 5 is pressed against the stops 22, 23 by a compression spring 4, which has the pull or push rod passing through it and is supported on the stops 35, the pressing being effected in such a manner that the push rod 3 can slide freely through the opening of the carry-along slide 5. On account of the biassing of the carry-along slide and of the associated tilting into engagement with the narrow edges of the pull or push rod 3, a displacement of the push rod 3 is possible only in the direction of the arrow.

The slot 11, which is located approximately in the vertex of the obtuse-angled actuating lever 6, is located approximately in the direction of extent of the actuating lever 6 and has a stationary bearing pin 8 passing through it. Engaging on the side of the second arm is a biassing spring 12 which acts substantially in the direction of extent of the slot, to be precise such that the operating arm 36 has its longest length without any opposing force.

Figure 2:
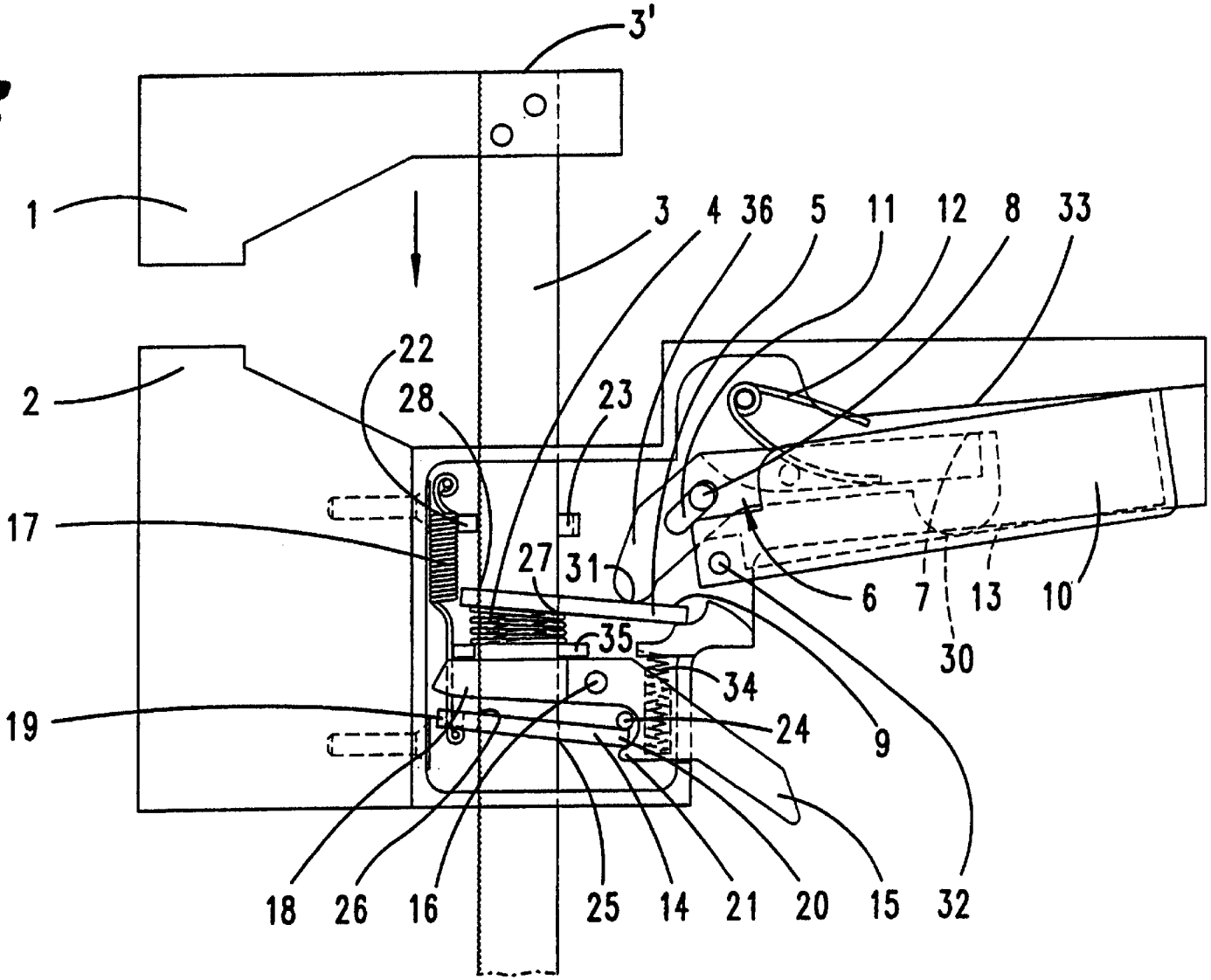
FIG. 2 shows a follow-up illustration to FIG. 1 with the handle actuated, in the non-gripping state.

If the actuating handle 10, as is illustrated in FIG. 2, is displaced against the grip portion 33, then, on the one hand, the biassing spring 12 is subjected to stressing and, on the other hand, by virtue of the operating arm 36 being pivoted, the carry-along slide 5 has the arm end 31 engaging against its engagement surface 9 and is displaced counter to the compression spring 4. On account of the tilting 27, 28, in the case of this handle actuation, the pull or push rod 3 is displaced in the direction of the arrow.

If the handle is released, then the actuating lever 6 is displaced back. The spring 4 displaces the carry-along slide 5 rearwards into the rest position.

Figure 3:
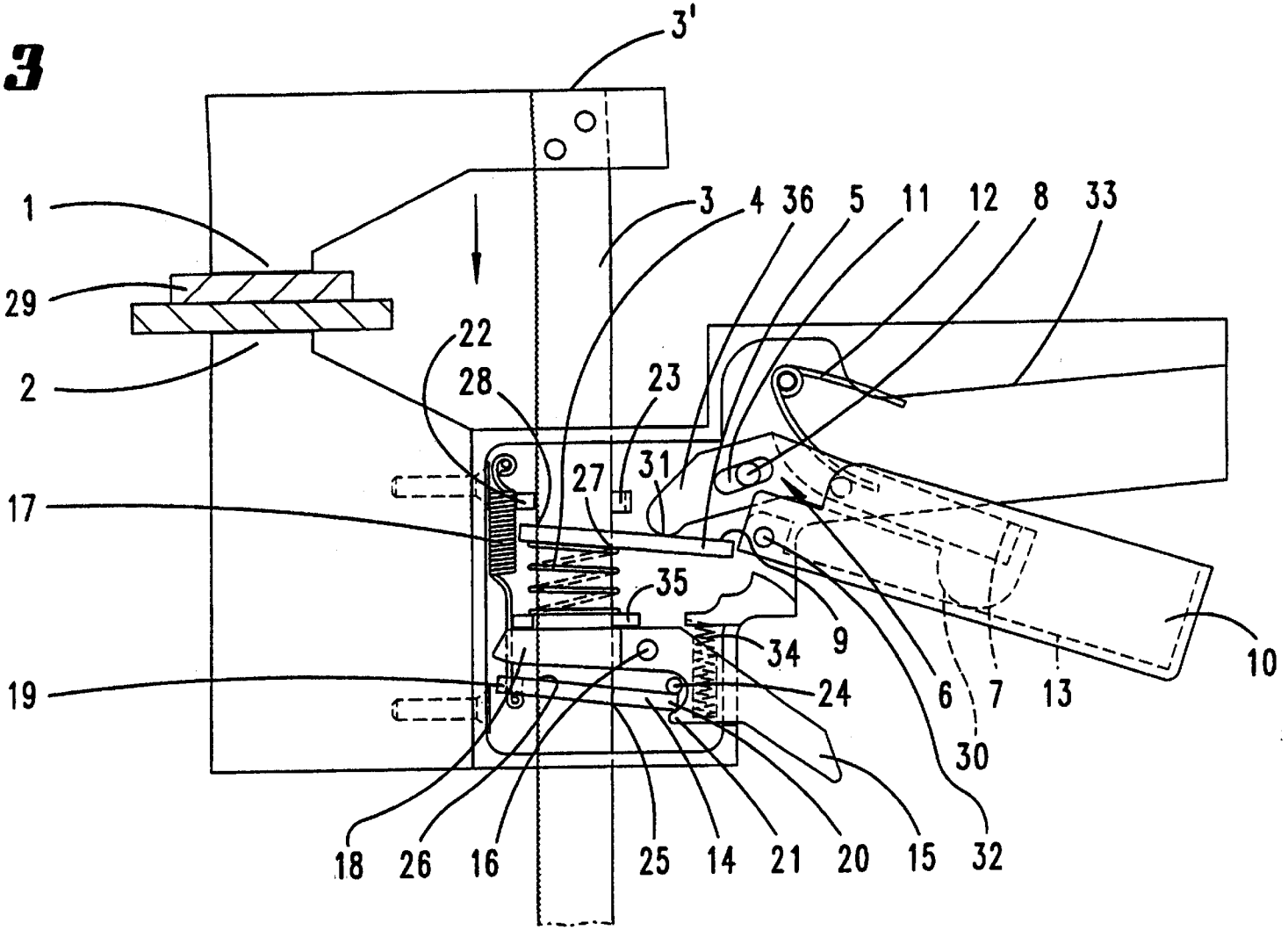
Figure 4:
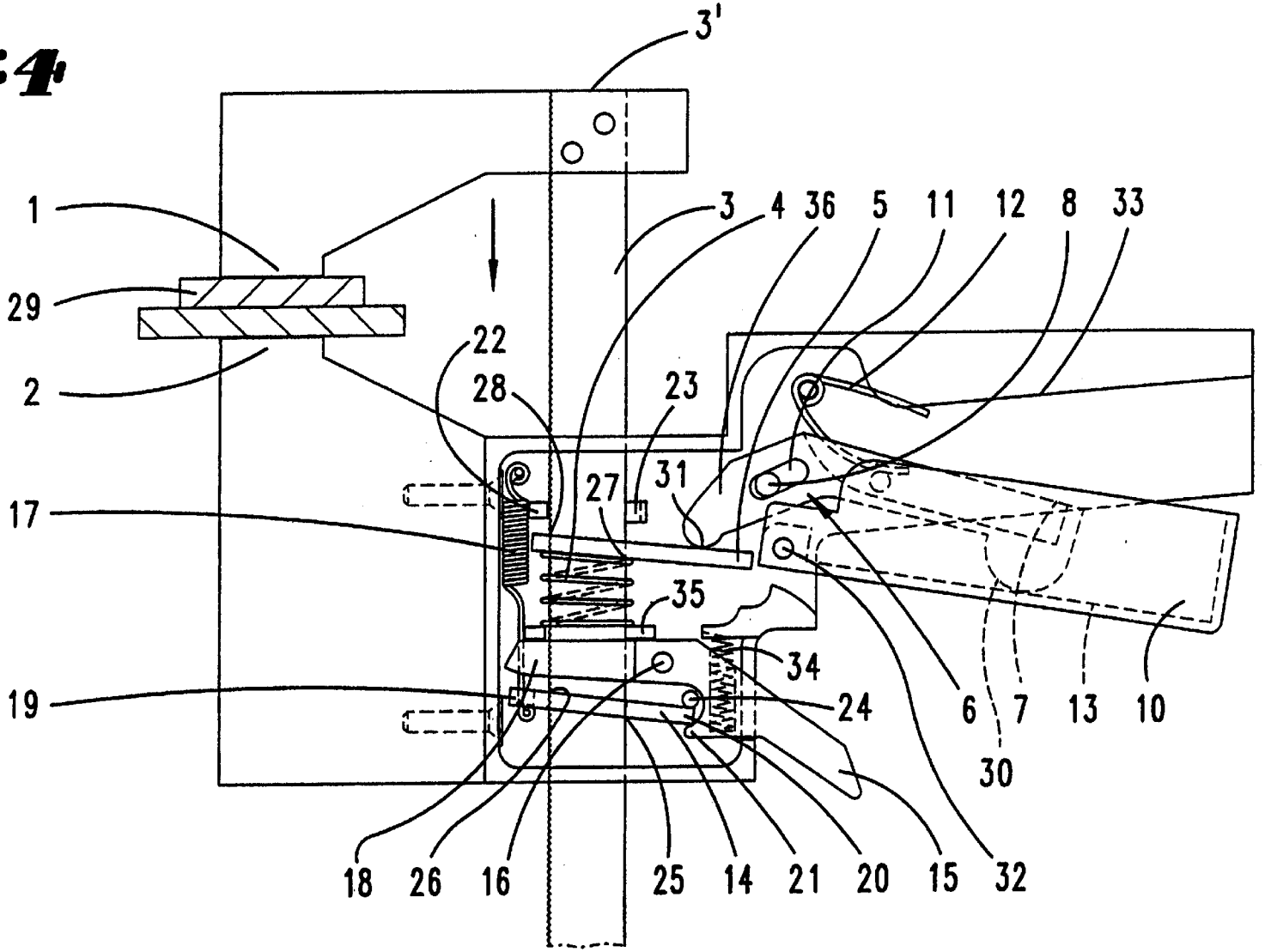
FIG. 4 shows a follow-up illustration to FIG. 3 with the handle actuated further and the grip arm shortened.
Figure 5:
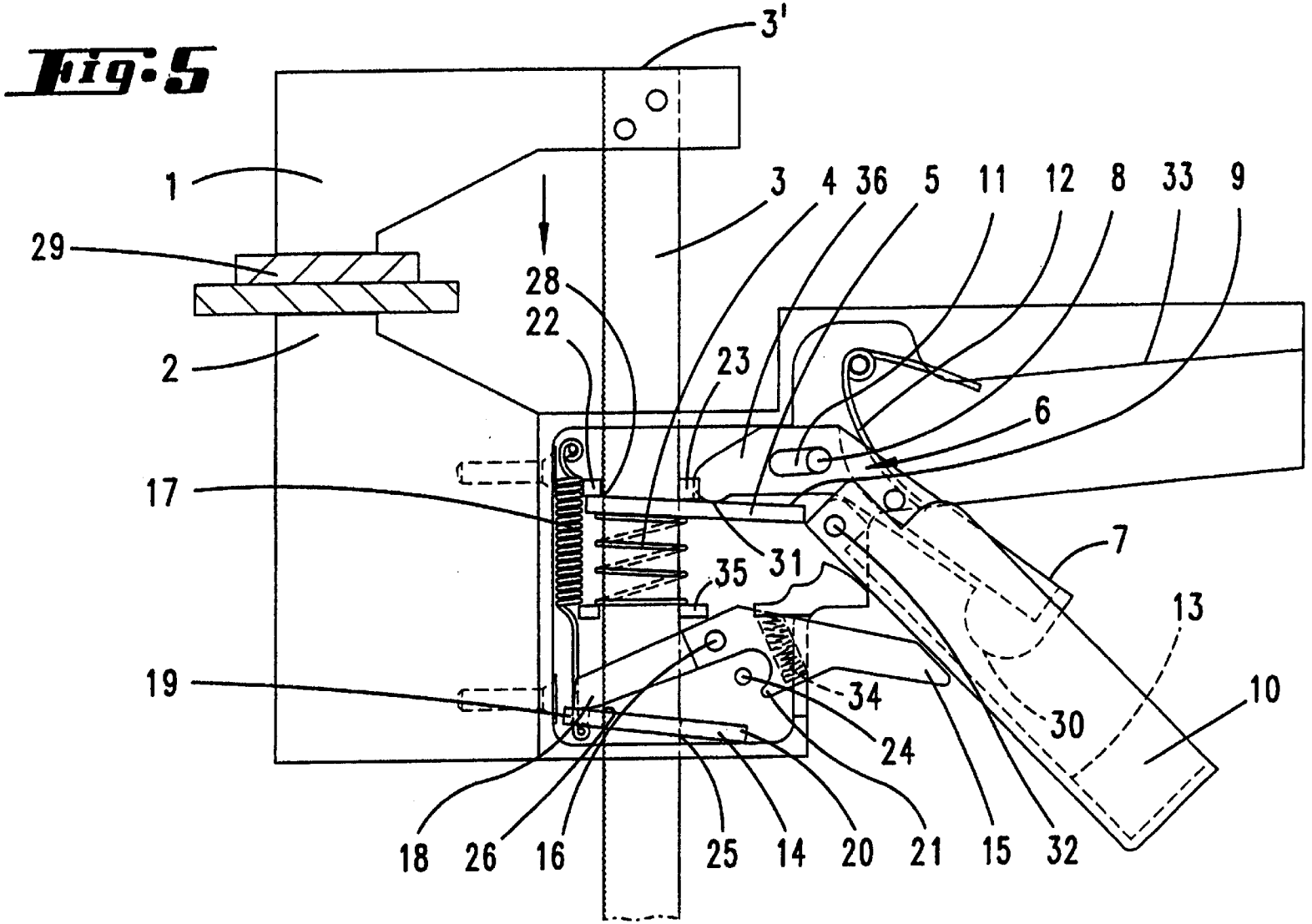
FIG. 5 shows a follow-up illustration to FIG. 4, where, in the clamping state, the return displacement detent has been released.
Figure 6:
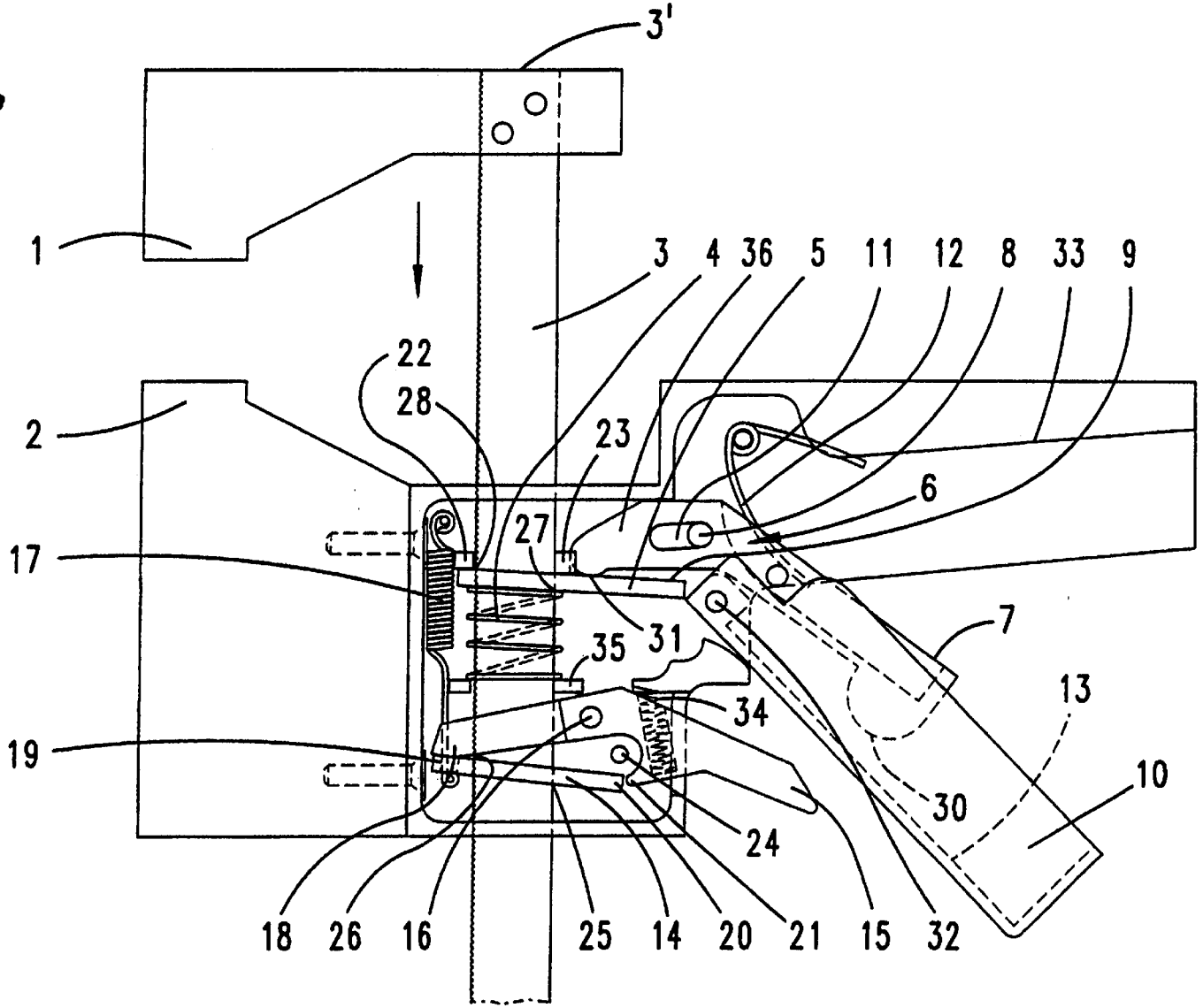
FIG. 6 shows a follow-up illustration to FIG. 5, the clamping jaws moving apart by actuation of the return displacement detent in the release direction.
Figure 4:
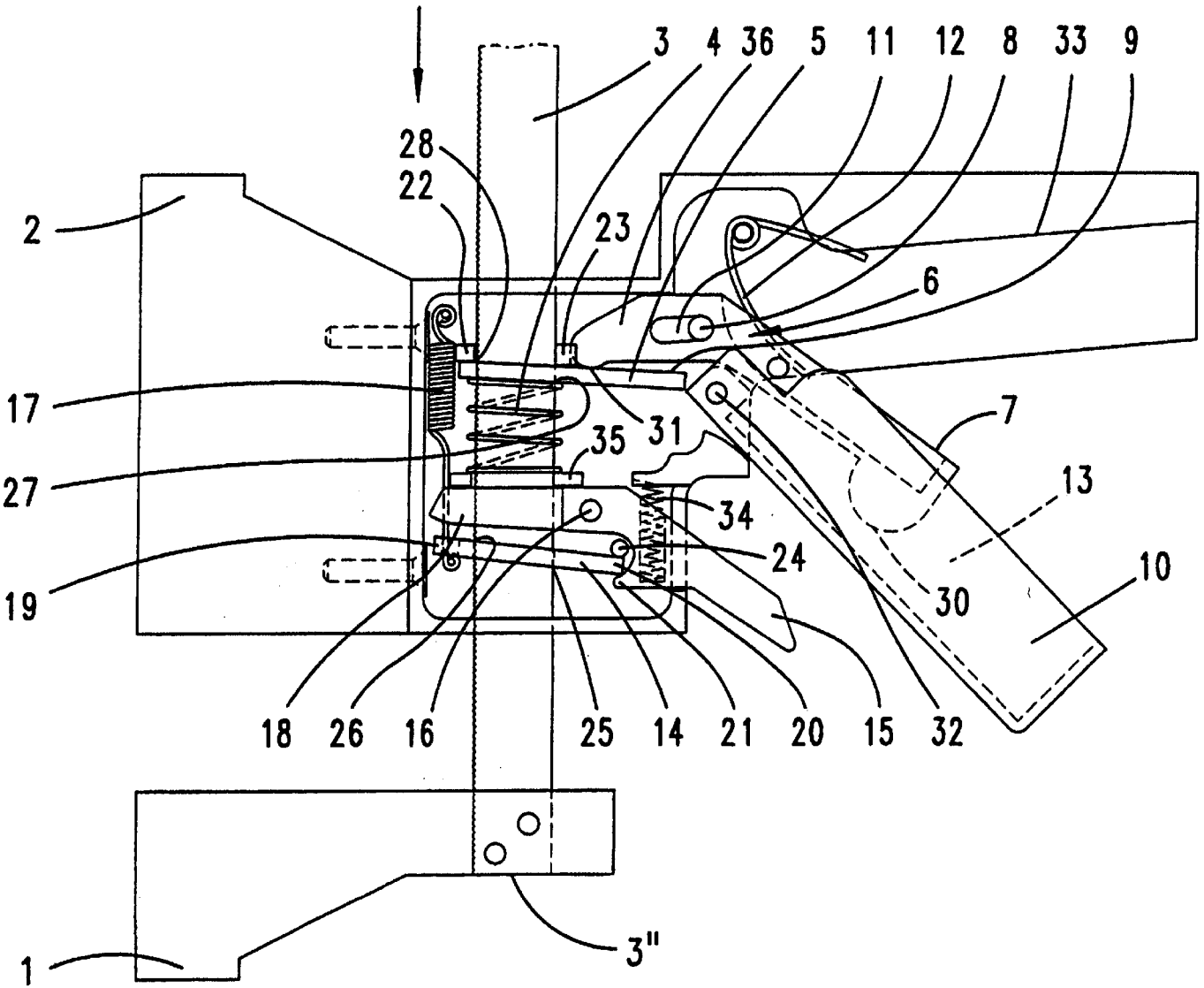

During this rearward displacement of the carry-along slide 5, the pull or push rod remains undisplaced since its displacement counter to the direction of the arrow is blocked on account of the detent slide 14 tilting into engagement 25, 26 with the pull or push rod 3. If, as is illustrated in FIG. 3, the two clamping jaws 1, 2 are moved together to the full extent, a workpiece 29 being clamped in between, then the force which is to be applied in order to displace the pull or push rod 3 relative to the clamping jaw increases. A greater force has to be applied by the handle 10. This force is transmitted to the actuating lever 6. The biassing of the spring 12 is overcome by, the increasing force component in the direction of the slot 11, with the result that the slot 11 can slide over the bearing pin 8, which results in the lever arm 36 being shortened. Along with this, the continuation 30 slides in the cavity 13 of the handle. On account of this shortening of the lever length of the operating arm 36, a greater force can be applied to the engagement surface 9 by means of the constant lever arm of the handle 10, with the result that it is possible to achieve a greater clamping force between the two clamping jaws 1 and 2 for expenditure of the same force, but it is also ensured that, in force-free operation, a high step width is assured upon handle actuation.

The detent slide 14 can be displaced in the direction of the arrow relative to the housing by handle actuation, just as for the carry-along slide 5. The displacement of the detent slide 4 is effected by actuation of the release lever 15. The release lever 15 is located in front of the handle 10 such that it can be actuated by the fingers of one hand which is brought into the clearance between handle 10 and grip 33 and engages the handle 10 in a gripping manner. Release is thus also possible if the workpiece extends beyond the push rod 3 and is located directly in front of the grip 33, which is located in approximate alignment with the fixed jaw 2. In particular when the workpiece comes into abutment against the grip 33, which is possible, for example, when the clamp operates in the expanding function illustrated in FIG. 7, it is no longer possible to enclose the grip. In the expanding function illustrated in FIG. 7, that peripheral edge of the grip 33 which extends in aligned prolongation with respect to the fixed clamping jaw 2 has even proven advantageous since it can serve as an additional abutment surface against a workpiece.

Despite access to the grip being adversely affected by such workpiece abutment, actuation of the handle 10 and of the release lever 15 is nevertheless possible without difficulty. The release lever 15 is located on the housing approximately diagonally opposite the fixed clamping jaw 2. It acts on the detent slide 14 such that, when the arm 18 of the release lever 1 engages against the detent slide 14, the tilted position is eliminated and the detent slide 14 can slide freely over the pull or push rod 3. For this purpose, the arm 18 engages on the engagement end 19 of the detent slide 14, the return spring 17 also engaging at this end. The return spring 17 is stressed by displacement of the detent slide 14 in the direction of the arrow. If the release lever 15 is released, then the return spring pulls the detent slide 14 at the engagement end 19 counter to the direction of the arrow. This single-sided loading of the release lever 15 causes tilting 25, 26 on the opposite sides of the opening in the detent slide 14. Together with this, the detent slide 14 is clamped on the pull or push rod 3, with the result that the push rod 3 is carried along by the return spring 17 counter to the direction of the arrow, with the result that the two clamping jaws 1, 2 are moved apart.

In the case of the expanding-function position illustrated in FIG. 7, the movable clamping jaw 1 is located at opposite ends 3" of the push rod 3.

Figure 8:
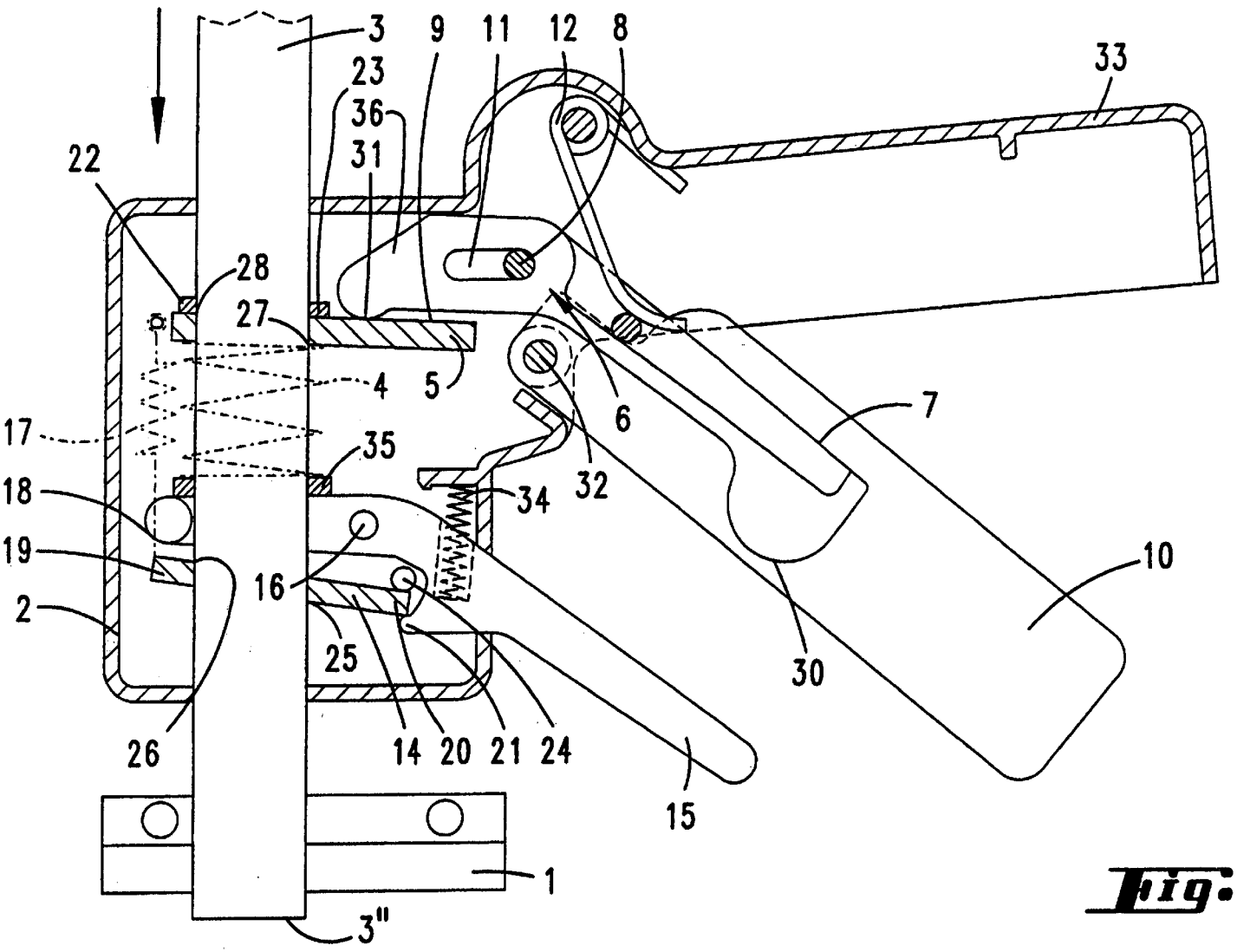
FIG. 8 shows a second exemplary embodiment of the invention.

The exemplary embodiment which is illustrated in FIG. 8 functions identically to the exemplary embodiment which is illustrated in FIGS. 1 to 7, the only differences being that the housing is of a different shape and the return spring 17 is somewhat shortened. Here too, the release lever 15, which can be pivoted about the bearing pin 16, is of fork-like form and provides a continuation 21 which defines a stop in order to press the opposite side 20 of the detent slide 14 against the fixed stop 24.

It is also the case in this version that the rear side of the grip 33 merges into a rearwardly jutting section from which the push rod 3 projects. As in the case of the embodiment illustrated in FIGS. 1–7, the rearwardly jutting section, which is adjacent to the push rod 3, is spaced apart from the release lever 15 to a lesser extent than the rear side of the grip 33.

Rather than just being used for a single-handed clamp, the abovedescribed mechanism can be used on any type of vice and, in particular, on a clamping bench. For use on a clamping bench, it is provided that the clamping jaws, located on two parallel members, transversely to the members, are guided in the parallel direction relative to the members and each member has a clamping mechanism as described above. Actuation can be effected here, in particular, by a foot pedal.

Figure 9:
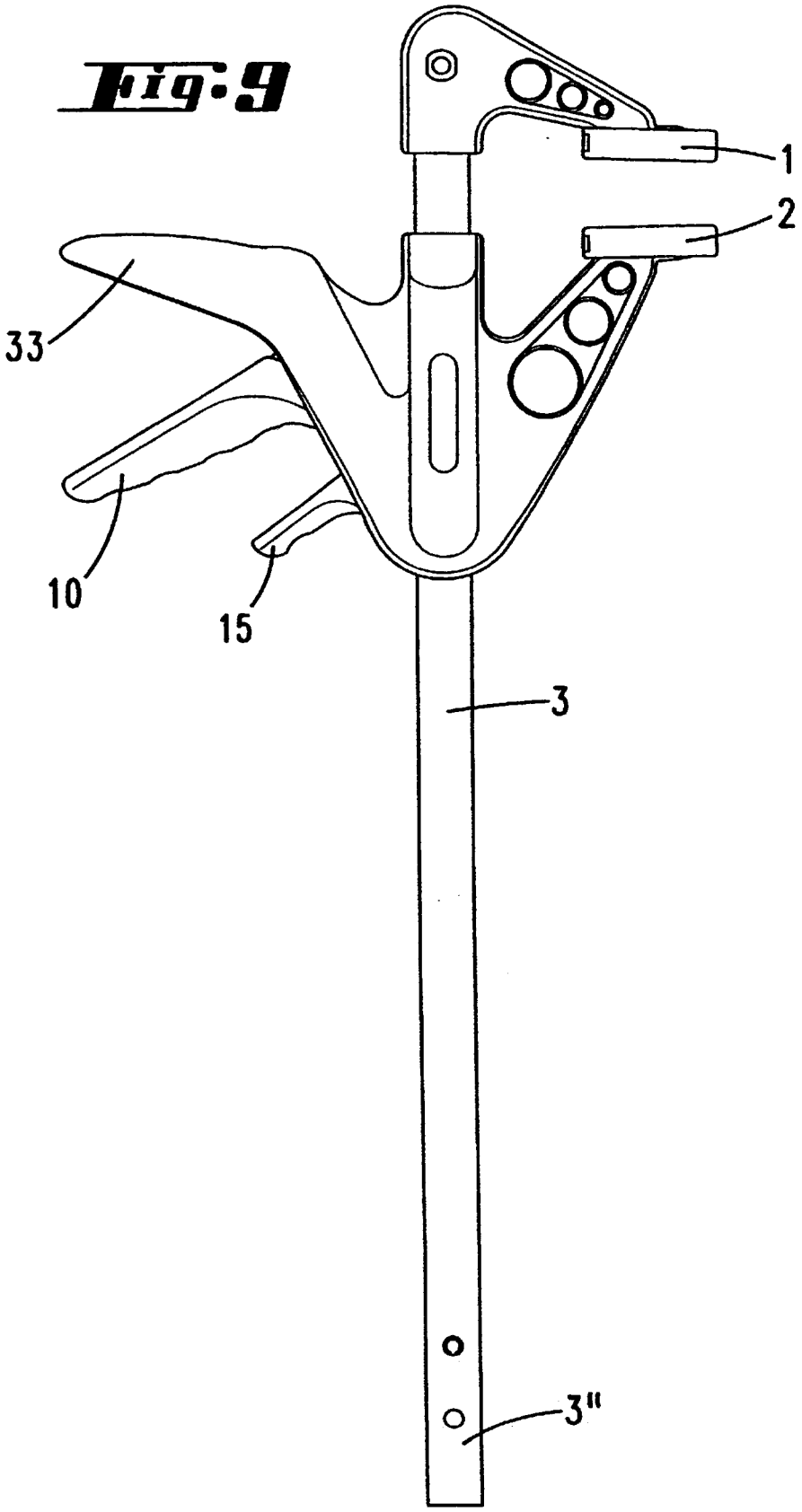
FIG. 9 shows a third exemplary embodiment of the invention.

The exemplary embodiment which is illustrated in FIG. 9 is distinguished by a housing shape of attractive configuration. Here too, the pivot points of release lever 15 and handle 10 are located on the side opposite the clamping jaws 1, 2 and on the same side as the levers 10, 15, which project out of the housing. Here too, grip 33, handle 10 and release lever 15 project separately and freely from the housing. While the grip 33 is located directly opposite the fixed clamping jaw, the release lever is located diagonally opposite the fixed clamping jaw. Here too, during clamping, the push rod or the movable jaw 1 is displaced in the direction counter to the actuating direction of the handle 10. This variant also allows the movable clamping jaw 1 to be mounted at the opposite end 3" of the push rod 3. In this position, the grip-forming arm 33, projecting from the housing, together with the fixed jaw 2, performs a supporting function.

All features disclosed are pertinent to the invention. The disclosure content of the associated/attached priority documents (copy of the prior application) is hereby also included in the disclosure of the application as to its full content, also for the purpose of including features of these documents in claims of the present application.

What is claimed is:

1. A clamp comprising:

a first jaw connected to an end of a rod, a second jaw connected to one side of a housing having a grip extending from a second side opposite the one side, the rod passing through the housing between the grip and the second jaw with the first jaw aligned with the second jaw, the housing being connected to a pivotable handle, the housing accommodating a carry-along member that engages the rod and the handle, the housing also accommodating a detent member that engages the rod, the handle being pivotable towards the grip whereby, as the handle is pivoted towards the grip, the handle imparts movement to the carry-along member which imparts movement to the rod in a clamping direction in a stepwise manner while engagement of the detent member and the rod prevents reverse movement of the rod in a release direction, the housing also being connected to a pivotable release lever which, upon pivotal movement towards the grip, engages the detent member to release the detent member from the rod to permit movement of the rod in the release direction, the handle and release lever being disposed in alignment with the grip and on the second side.

2. The clamp of claim 1 wherein the release lever is disposed diagonally opposite the housing from the second jaw with the handle being disposed between the release lever and the grip.

3. The clamp of claim 1 wherein the grip is aligned with the second jaw.

4. The clamp of claim 1 wherein the first jaw may be connected to one of two ends of the rod.

5. A clamp comprising:

a first jaw connected to an end of a rod, a second jaw connected to a housing, the rod passing through the housing, the housing being connected to a pivotable handle, the handle engaging an operating arm, the operating arm being slidably connected to the housing so that the operating arm is capable of sliding movement with respect to the handle to shorten or lengthen an overall combined length of the handle and operating arm, the housing accommodating a carry-along member that engages the rod and the operating arm, the housing also accommodating a detent member that engages the rod, as the handle is pivoted, the operating arm imparts force and movement to the carry-along member which imparts movement to the rod in a clamping direction in a stepwise manner while engagement of the detent member and the rod prevents reverse movement of the rod in a release direction, the housing also being connected to a pivotable release lever which can engage the detent member to release the detent member from the rod to permit movement of the rod in the release direction, the carry-along member being biased against the force and movement imparted by the operating arm, wherein as a clamping force increases, the operating arm slides towards the handle to shorten the overall length of the handle and operating arm.

6. The clamp of claim 5 wherein the carry-along member comprises a smooth surface which is engaged by the operating arm.

7. The clamp of claim 5 wherein the operating arm is connected to the housing by a pin that is received in a slot disposed in the operating arm.

8. The clamp of claim 7 wherein the operating arm is angled and comprises a vertex, the slot being disposed in the vertex of the operating arm.

9. The clamp of claim 5 wherein the operating arm and the handle form an actuating lever which has an alterable bearing point.

10. The clamp of claim 9 wherein the handle engages a second arm which, in turn, engages the operating arm.

11. The clamp of claim 10 wherein the second arm is biased towards the slot in the operating arm by a spring.

12. The clamp of claim 10 wherein the handle comprises a cavity for sliding receiving the second arm.

13. The clamp of claim 5 wherein the operating arm is spring biased away from the handle to lengthen the overall length of the operating arm and handle.

14. The clamp of claim 5 wherein the first jaw may be connected to one of two ends of the rod.

15. The clamp of claim 5 wherein the release lever is disposed diagonally opposite the housing from the second jaw with the handle being disposed between the release lever and the grip.

16. The clamp of claim 5 wherein the grip is aligned with the second jaw but opposite the rod from the second jaw.

17. A clamp comprising:

a first jaw connected to an end of a rod, a second jaw connected to a housing, the rod passing through the housing, the housing being connected to a pivotable handle, the housing accommodating a carry-along member that engages the rod and the handle, the housing also accommodating a detent member that engages the rod, as the handle is pivoted, the handle imparts force and movement to the carry-along member which imparts movement to the rod in a clamping direction in a stepwise manner while engagement of the detent member and the rod prevents reverse movement of the rod in a release direction, the carry-along member being biased against the force and movement imparted by the handle arm, the housing also being connected to a pivotable release lever which can engage the detent member to release the detent member from the rod to permit movement of the rod in the release direction, the detent member being biased against the force and movement imparted by the release lever, further pivotal movement of the release lever imparting sufficient force and movement to the detent member along the rod until the detent member reengages the rod and the biasing force imposed on the detent member imparts movement of the rod in the release direction upon disengagement of the release lever from the detent member.

18. The clamp of claim 17 further comprising a return spring which engages one side of the detent member while a fixed stop engages an opposing side of the detent member.

19. The clamp of claim 18 wherein the release lever engages said one side of the detent member.

20. The clamp of claim 17 wherein the carry-along member comprises an opening through which the rod passes and the opening comprises at least one side edge for grippingly engaging the rod.

21. The clamp of claim 17 wherein the detent member comprises an opening through which the rod passes and the opening comprises at least one side edge for grippingly engaging the rod.

* * * * *